US006708374B2

(12) United States Patent
Mandel

(10) Patent No.: US 6,708,374 B2
(45) Date of Patent: Mar. 23, 2004

(54) REFRIGERATOR DOOR HANDLE

(75) Inventor: Sheldon W. Mandel, East Galesburg, IL (US)

(73) Assignee: Maytag Corporation, Newton, IA (US)

( * ) Notice: Subject to any disclaimer, the term of this patent is extended or adjusted under 35 U.S.C. 154(b) by 66 days.

(21) Appl. No.: 10/058,747

(22) Filed: Jan. 30, 2002

(65) Prior Publication Data

US 2003/0145433 A1 Aug. 7, 2003

(51) Int. Cl.[7] ..... E05B 1/00
(52) U.S. Cl. ..... 16/436; 16/412; 312/405
(58) Field of Search ..... 16/436, 412, DIG. 41, 16/DIG. 40; 312/401, 405; 403/315, 320; 292/DIG. 71

(56) References Cited

U.S. PATENT DOCUMENTS

| | | | | |
|---|---|---|---|---|
| 2,870,493 A | | 1/1959 | Beyrle | |
| 3,648,411 A | * | 3/1972 | Saunders et al. | 49/460 |
| 3,995,349 A | * | 12/1976 | Roberts et al. | 16/412 |
| 4,151,681 A | * | 5/1979 | Roberts | 49/382 |
| 4,926,523 A | | 5/1990 | Carlson et al. | |
| 5,402,553 A | | 4/1995 | Goetz et al. | |
| 5,493,756 A | | 2/1996 | Shanok et al. | |
| 5,659,927 A | | 8/1997 | Shanok et al. | |
| 5,675,867 A | * | 10/1997 | Howie, Jr. | 16/412 |
| 5,797,164 A | | 8/1998 | Donaghy | |
| 5,890,261 A | * | 4/1999 | Mantarakis | 16/413 |
| 6,375,291 B1 | * | 4/2002 | Nam et al. | 312/405 |
| 6,546,597 B2 | * | 4/2003 | Atalla et al. | 16/436 |

FOREIGN PATENT DOCUMENTS

JP 59-153633 * 9/1984

* cited by examiner

*Primary Examiner*—Robert J. Sandy
*Assistant Examiner*—André L. Jackson
(74) *Attorney, Agent, or Firm*—Diederiks & Whitelaw, PLC

(57) ABSTRACT

A plastic terminal end section of a refrigerator handle is secured to an upper in-turned portion of a refrigerator door by forming the end section with a lower channel defined, at least in part, by in-turned, tie-down flanges. The overall mounting assembly also incorporates a metal plate which slips into the channel and receives mechanical fasteners such that the fasteners extend into the terminal end section of the handle, through the metal plate, and into the door. With this arrangement, the metal plate functions to clamp down the tie-down flanges to the door when the fasteners are tightened, thereby securing the terminal end section of the handle to the door.

20 Claims, 2 Drawing Sheets

REFRIGERATOR DOOR HANDLE

BACKGROUND OF THE INVENTION

1. Field of the Invention

The present invention pertains to the art of refrigerators and, more particularly, to the construction and mounting of a handle to the door of a refrigerator.

2. Discussion of the Prior Art

Although refrigerator handles which are generally recessed with respect to front panels of doors are known, the clear majority of the refrigerators on the market today are provided with handles which are attached to and project from the front panels. The projecting portions of the handles define zones which can be gripped by a user to open or close the refrigerator doors. Often, such a known refrigerator handle is secured solely to a respective front door panel, generally by securing a base plate to the door panel, then securing a handle to the base plate, and finally attaching a cover strip to the handle. Another known handle arrangement has one end portion of a handle secured directly to the front door panel, with an opposing end of the handle extending across and being secured to an in-turned top portion of the door.

In order to reduce costs and often times increase the aesthetics of refrigerator handles, it is heretofore been proposed to form handles from plastic. In such situations, it must be realized that refrigerator handles actually need to withstand a fair level of fatigue loading that can loosen mounting screws and even cause a handle to crack. To address at least these concerns, there exists a need in the art for a refrigerator handle mounting arrangement, particularly for refrigerator handles formed from plastic, which establishes a relatively large mounting or clamping surface, and minimizes the placement of the plastic in the mounting zone in tension, thereby promoting reliability in the overall mounting of the handle.

SUMMARY OF THE INVENTION

The present invention is directed to the mounting of an end portion of a refrigerator handle to an in-turned upper portion of a refrigerator door. More specifically, the handle includes a main body portion that extends along the front panel of the refrigerator door, with the main body portion leads through a curved section to a terminal end portion which is adapted to be secured to the in-turned upper portion of the door through the use of mechanical fasteners, such as screws. In accordance with the invention, the terminal end portion is formed with tie-down flanges which define a channel at the terminal end portion.

In a preferred embodiment, the handle, particularly the terminal end portion, is molded of plastic such that the tie-down flanges are integrally formed as part of the remainder of the terminal end portion and, most preferably, the entire handle. The mounting assembly also incorporates a metal plate which slips into the channel and receives the mechanical fasteners such that the fasteners extend into the terminal end portion of the plastic handle, through the metal plate, and into the door. With this arrangement, the metal plate functions to clamp down the tie-down flanges to the door when the fasteners are tightened.

Additional objects, features and advantages of the present invention will become more readily apparent from the following detailed description of a preferred embodiment when taken in conjunction with the drawing wherein like reference numerals refer to corresponding parts in the several views.

DETAILED DESCRIPTION OF THE PREFERRED EMBODIMENT

Figure 1:
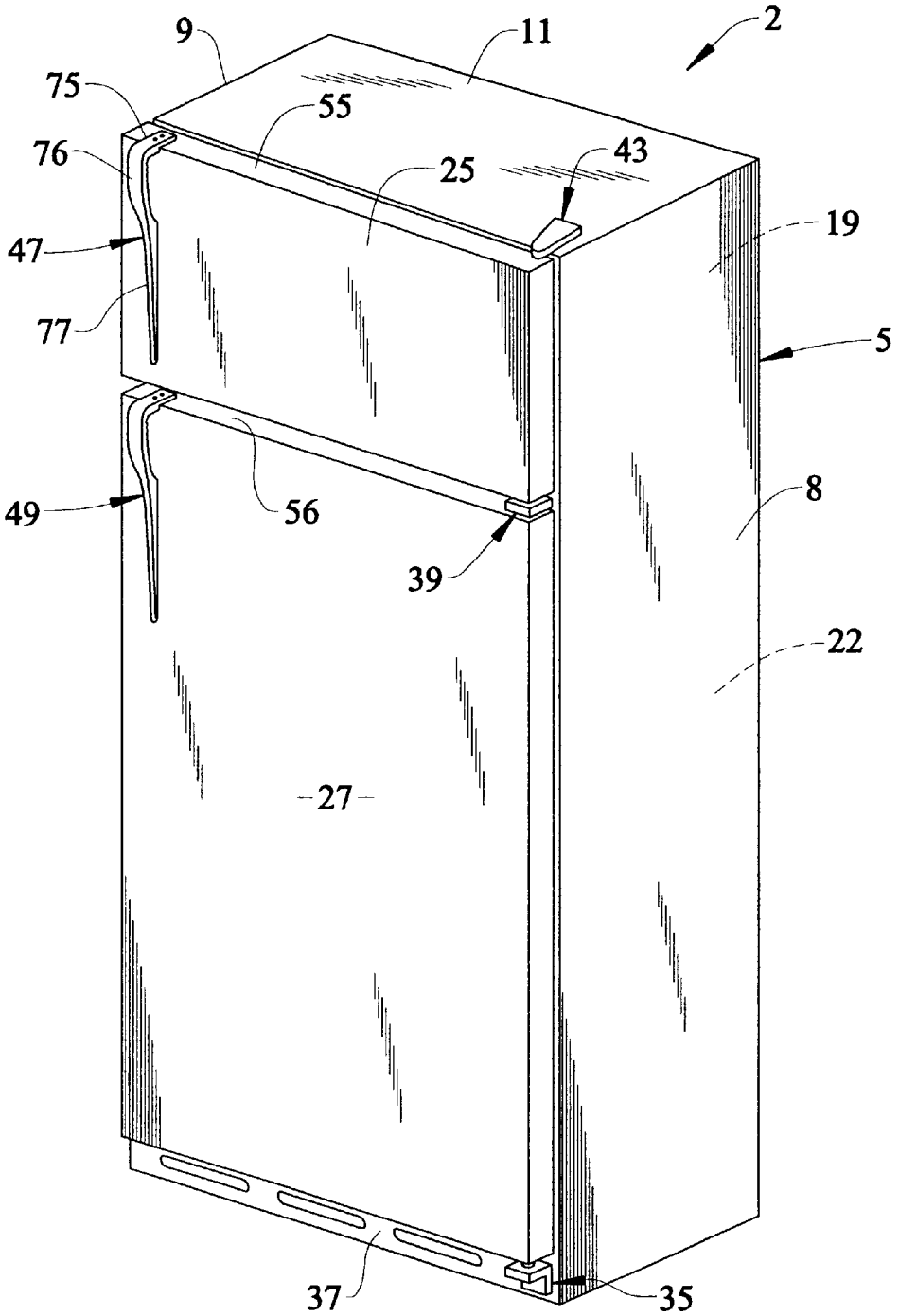
FIG. 1 is an upper right perspective view of a refrigerator incorporating the door handle arrangement of the present invention.

With initial reference to FIG. 1, a top mount refrigerator 2 includes a cabinet shell 5 defined, at least in part, by first and second upstanding side panels 8 and 9 that are interconnected and laterally spaced by a top panel 11. Although not shown in this figure, cabinet shell 5 would also include a rear panel and internal reinforcing structure. Since refrigerator 2 constitutes a top mount style refrigerator, a mullion (not separately labeled) is provided which extends laterally across shell 5 and divides refrigerator 2 into an upper freezer compartment 19 and a lower fresh food compartment 22. Although not particularly illustrated, both the freezer and fresh food compartments 19 and 22 are preferably defined by respective liners installed within shell 5 in a manner known in the art.

As illustrated, a freezer door 25 is provided to selectively seal freezer compartment 19 and a fresh food door 27 is provided to selectively seal fresh food compartment 22. Door 27 is actually mounted for pivotal movement relative to shell 5 by means of a lower hinge unit 35 that is secured to reinforcement structure of refrigerator 2 at the level of a conventional kickplate 37 and a center hinge unit 39. Freezer door 25 is also mounted through center hinge unit 39 and an upper hinge unit 43 for pivotal movement relative to shell 5 in order to provide selective access to within upper freezer compartment 19. In order to open and close doors 25 and 27, refrigerator 2 is provided with handles 47 and 49 respectively.

At this point, it should be recognized that the basic structure described above is known in the art and refers to conventional top mount refrigerator structure. Substantially corresponding structure exists with respect to bottom mount refrigerators wherein the freezer compartment is merely located below the fresh food compartment, side-by-side refrigerators wherein the fresh food and freezer compartments are located laterally adjacent each other, and other combinations of these arrangements. As this structure is known, it will not be discussed further here. Instead, the present invention is particularly directed to the manner in which one or more of handles 47 and 49 are secured to doors 25 and 27 and, more particularly, the structure and mounting arrangement for one or more of handles 47 and 49 to a respective in-turned upper portion 55, 56 of doors 25 and 27 respectively. Since handles 47 and 49 are preferably constructed and mounted in identical manners in accordance with the invention, the most preferred construction and mounting of handle 47 will now be described in detail and it is to be understood that a corresponding arrangement exists with respect to handle 49.

As shown, handle 47 includes a first end portion 75, an intermediate, gripping portion 76 and a second, elongated end portion 77. In accordance with the most preferred form of the invention, the handle 47 is entirely made of plastic and can take various different configurations without departing from the invention. Handle 47 is preferably attached to door 25 at both first and second end portions 75 and 77. However, the specific manner of attachment of second end portion 77 to door 25 does not form part of the present invention. Instead, this attachment can be performed in any manner known in the art, such as by initially affixing a base plate (not shown) to the front of door 25 and then attaching second end portion 77 to the base plate.

Figure 2:
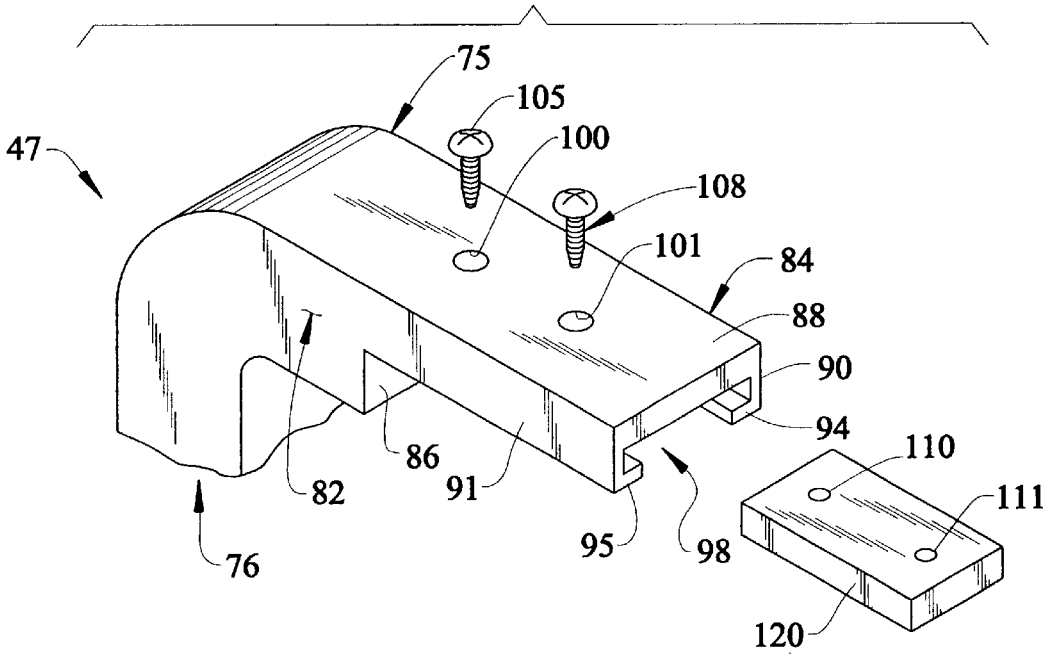
FIG. 2 is an exploded view of an upper end portion of the door handle constructed in accordance with the present invention.

FIG. 2 illustrates the preferred construction of first end portion 75. As shown, first end portion 75 includes a first section 82 and a second section 84. Second section 84 has a reduced thickness as compared to first section 82 such that a substantially vertical wall 86 is defined at the junction between first and second sections 82 and 84. As shown, first and second sections 82 and 84 have a common top wall 88. Second section 84 also has opposing side walls 90 and 91, each of which terminates in a respective in-turned, tie-down flange 94, 95. As shown, flanges 94 and 95 are spaced and extend substantially parallel to each other. With this construction, second section 84 defines a channel 98. In addition, second section 84 is formed with a pair of spaced holes 100 and 101 which extend through top wall 88 and lead into channel 98. In accordance with the most preferred form of the invention, holes 100 and 101 are sized to receive the head 105 of a respective fastening screw 108.

Figure 3:
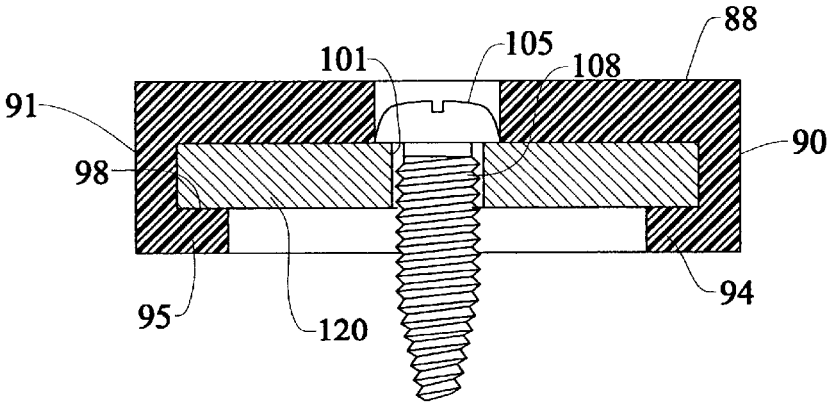
FIG. 3 is a cross-sectional view of the upper end portion of the door handle in an assembled condition.

Holes 100 and 101 are spaced in second section 84 a distance the same as holes 110 and 111 provided in a mounting plate 120. Mounting plate 120 is preferably made of metal, such as steel or aluminum. Plate 120 is sized to snugly fit into channel 98, whereupon plate 120 rests upon flanges 94 and 95 (see FIG. 3). With this arrangement, first end portion 75 is adapted to be mounted to in-turned upper portion 55, with second section 84 resting directly upon upper portion 55 and wall 86 generally abutting a front panel portion (not separately labeled) of door 25. At this point, plate 120 is arranged within channel 98 such that, upon inserting screws 108 through respective aligned holes 100, 110 and 101, 111 and tightening the screws 108 into upper portion 55 of door 25, first end portion 75 is affixed to door 25 with heads 105 being substantially flush with or slightly recessed within top wall 88. More specifically, first end portion 75 is mounted to door 25 by clamping flanges 94 and 95 directly against upper portion 55 through plate 120. Although not required, heads 105 preferably bear directly against plate 120 to avoid local stresses on the plastic at second section 84. In any event, with this arrangement, metal plate 120 functions to clamp the tie-down flanges 94 and 95 to door 25 when the fastener screws 108 are tightened to provide a structurally sound and overall cost efficient handle assembly.

Although described with reference to a preferred embodiment of the invention, it should be readily understood that various changes and/or modifications can be made to the invention without departing from the spirit thereof. In general, the invention is only intended to be limited by the scope of the following claims.

I claim:

1. In a refrigerator including a cabinet and at least one door, having a front panel portion and an in-turned upper portion, hinged to the cabinet, a handle assembly for use in opening and closing the door comprising:

a handle member including a first end portion, an intermediate portion and a second end portion, said first end portion being angled with respect to said second end portion and having a terminal channel, wherein the first end portion includes a pair of spaced side walls which are interconnected by a top wall, with the side walls terminating in respective in-turned, tie-down flanges, with the top wall, side walls and tie-down flanges defining the channel; and a plurality of fasteners extending into the first end portion of the handle member and into the in-turned upper portion of the door, with the tie-down flanges of the first end portion directly abutting the in-turned upper portion of the door, thereby securing the handle member to the door with the second end portion of the handle member extending along the front panel portion.

2. The handle assembly according to claim 1, further comprising:

a plate member, separate from the handle member, positioned in the channel, wherein the handle member is made of plastic and the plate member is made of metal.

3. The handle assembly according to claim 1, wherein the second end portion of the handle member is secured to the front panel portion and the intermediate portion is spaced from the front panel portion so as to define a gripping portion of the handle member.

4. The handle assembly according to claim 1, further comprising: a plate member, separate from the handle member, positioned in the channel.

5. The handle assembly according to claim 4, wherein the tie-down flanges are clamped to the in-turned upper portion through the plate member.

6. The handle assembly according to claim 5, further comprising: at least a pair of spaced holes extending through the first end portion, said fasteners including a pair of screws positioned in the holes.

7. The handle assembly according to claim 1, wherein the first end portion includes a first section and a second, reduced thickness section, said channel being defined in the second section.

8. The handle assembly according to claim 7, wherein the first end portion further includes a wall at a junction between the first and second sections, said wall abutting the front panel portion of the door.

9. In a refrigerator including a cabinet and at least one door, having a front panel portion and an in-turned upper portion, hinged to the cabinet, a handle assembly for use in opening and closing the door comprising:

a handle member including a first end portion, an intermediate portion and a second end portion, said first end portion being angled with respect to said second end portion and having a terminal channel;

a plate member, separate from the handle member, positioned in the channel; and a plurality of fasteners extending into the first end portion of the handle member, through the plate member and into the in-turned upper portion of the door, thereby securing the handle member to the door with the second end portion of the handle member extending along the front panel portion.

10. The handle assembly according to claim 9, wherein the handle member is made of plastic and the plate member is made of metal.

11. The handle assembly according to claim 9, wherein the second end portion of the handle member is secured to the front panel portion and the intermediate portion is spaced from the front panel portion so as to define a gripping portion of the handle member.

12. The handle assembly according to claim 9, wherein the first end portion includes a pair of spaced side walls which are interconnected by a top wall, each of the side walls terminating in in-turned, tie-down flanges, with the top wall, side walls and tie-down flanges defining the channel.

13. The handle assembly according to claim 12, wherein the tie-down flanges of the first end portion directly abut the in-turned upper portion of the door.

14. The handle assembly according to claim 13, wherein the tie-down flanges are clamped to the in-turned upper portion through the plate member.

15. The handle assembly according to claim 13, further comprising: at least a pair of spaced holes extending through the first end portion, said fasteners including a pair of screws positioned in the holes.

16. The handle assembly according to claim 9, wherein the first end portion includes a first section and a second, reduced thickness section, said channel being defined in the second section.

17. The handle assembly according to claim 16, wherein the first end portion further includes a wall at a junction between the first and second sections, said wall abutting the front panel portion of the door.

18. A method of securing a handle member to a refrigerator door having a front panel portion and an in-turned upper portion comprising:

positioning a first end portion of the handle member adjacent the in-turned upper portion of the refrigerator door;

arranging a plate member within a channel defined in the first end portion of the handle member; and fixedly securing the first end portion to the in-turned upper portion of the door through the plate member.

19. The method of claim 18, further comprising:

creating the channel by forming the first end portion with a pair of spaced side walls which are interconnected by a top wall and terminate in in-turned, tie-down flanges; and clamping the tie-down flanges directly to the in-turned upper portion of the door, through the plate member, in order to fixedly secure the first end portion to the door.

20. The method of claim 19, further comprising: abutting the front panel portion of the door with a vertical wall section formed as part of the first end portion.

* * * * *